United States Patent [19]

Kindlmann et al.

[11] Patent Number: 4,495,983

[45] Date of Patent: Jan. 29, 1985

[54] DETERMINATION OF LIQUID-SOLID INTERFACE AND HEAD IN ELECTROMAGNETIC CASTING

[75] Inventors: Peter J. Kindlmann, Northford; Gary L. Ungarean, Woodbridge; John C. Yarwood, Madison; Derek E. Tyler, Cheshire, all of Conn.

[73] Assignee: Olin Corporation, New Haven, Conn.

[21] Appl. No.: 465,239

[22] Filed: Feb. 10, 1983

Related U.S. Application Data

[63] Continuation of Ser. No. 137,645, Apr. 7, 1980, abandoned.

[51] Int. Cl.[3] ..... B22D 27/02

[52] U.S. Cl. ..... 164/452; 164/467; 164/503; 164/154

[58] Field of Search ..... 164/452, 467, 503, 154

[56] References Cited

U.S. PATENT DOCUMENTS

| | | |
|---|---|---|
| 3,204,460 | 9/1965 | Milnes . |
| 3,237,251 | 3/1966 | Thalmann . |
| 3,467,166 | 9/1969 | Getseley et al. . |
| 3,646,988 | 3/1972 | Getseley . |
| 3,667,296 | 6/1972 | Schiefer et al. . |
| 3,838,727 | 10/1974 | Levi et al. . |
| 3,842,894 | 10/1974 | Southworth et al. . |
| 4,014,379 | 3/1977 | Getseley . |
| 4,015,128 | 3/1977 | Della Vedova . |
| 4,132,259 | 1/1979 | Poncet . |
| 4,160,168 | 7/1979 | Funck . |
| 4,161,206 | 7/1979 | Yarwood et al. ..... 164/467 |

FOREIGN PATENT DOCUMENTS

| | | |
|---|---|---|
| 833454 | 2/1970 | Canada . |
| 913323 | 10/1972 | Canada . |
| 2027805 | 12/1971 | Fed. Rep. of Germany . |
| 2812279 | 9/1979 | Fed. Rep. of Germany . |
| 2853792 | 11/1979 | Fed. Rep. of Germany . |
| 273226 | 10/1970 | U.S.S.R. . |
| 338297 | 6/1972 | U.S.S.R. . |
| 338036 | 5/1977 | U.S.S.R. . |
| 603489 | 3/1978 | U.S.S.R. . |

OTHER PUBLICATIONS

". . . Develops New Molten Metal Measuring System for Continuous-Casters . . . ", Journal of Metals, Jul., 1979, pp. 14–15.

*Primary Examiner*—Kuang Y. Lin

*Attorney, Agent, or Firm*—Howard M. Cohn; Barry L. Kelmachter; Paul Weinstein

[57] ABSTRACT

An apparatus and process for casting metals wherein the molten metal is contained and formed into a desired shape by the application of an electromagnetic field established by an inductor. The height of the liquid metal head, the location of the liquid-solid interface at the periphery of the forming ingot, and/or variations in the values of these parameters is displayed during the casting run by a system which monitors the in-phase component of the voltage across the inductor to determine variations in the total equivalent series resistance of the electromagnetic casting system as seen by the inductor.

10 Claims, 3 Drawing Figures

DETERMINATION OF LIQUID-SOLID INTERFACE AND HEAD IN ELECTROMAGNETIC CASTING

This application is a continuation of application Ser. No. 137,645 filed Apr. 7, 1980 now abandoned.

CROSS REFERENCES TO OTHER APPLICATIONS

The present invention relates to U.S. patent application No. 277,759 entitled "Control of Liquid-Solid Interface in Electromagnetic Casting", by Yarwood et al., filed June 26, 1981; U.S. patent application No. 231,209 entitled "Transformer-Driven Shield for Electromagnetic Casting" by Kindlmann et al., filed Feb. 4, 1981 (now abandoned); U.S. patent application No. 957,420 entitled "Electromagnetic Casting Method and Apparatus" by Yarwood et al., filed Nov. 2, 1978; U.S. patent application No. 350,846 entitled "Electromagnetic Casting Process and Apparatus" by Ungarean et al. (a continuation of Ser. No. 110,893), filed Feb. 22, 1982.

BACKGROUND OF THE INVENTION

One method of controlling the casting process has been the use of an induced electromagnetic (EM) field, rather than a mold with definite walls, to both confine and shape the molten metal or alloy which is being cast. This process utilizes a strong electromagnetic field to counterbalance the metallostatic forces effected by the head of molten metal or alloy.

It has generally been necessary to employ relatively low heads of pressure in the molten metal to minimize the power requirements of the electromagnetic field utilized in such a process. Molten metal or alloy head thus becomes an important parameter to measure, as does any change in head during an electromagnetic casting run. In addition, metal or alloy head control in such a process should be sufficiently precise to minimize fluctuations in the metallostatic forces and prevent surges of high velocity molten metal streams within the casting. Accurate knowledge of the height of the liquid metal head and the position of the liquid-solid interface at the periphery of the casting relative to the inductor in an electromagnetic casting operation can be a useful tool in improving overall performance of such operations. For example, ideally it is desired to maintain the position of the liquid-solid interface at the periphery of the forming ingot at the longitudinal center (magnetic center) of the inductor where the field is greatest. This will counteract the maximum static force which is exhibited in the ingot at this point. In addition, control of the location of the liquid-solid interface is essential in prevention of metal spillout or cold folding. This provides added control in that coolant may be caused to impinge upon the forming ingot at the appropriate elevation.

PRIOR ART STATEMENT

The electromagnetic casting apparatus comprises a three part mold consisting of a water cooled inductor, a non-magnetic screen, and a manifold for applying cooling water to the ingot. Such an apparatus is exemplified in U.S. Pat. No. 3,467,166. Containment of the molten metal is achieved without direct contact between the molten metal and any component of the mold. Solidification of the molten metal is achieved by direct application of water from the cooling manifold to the ingot shell.

When one attempts to electromagnetically cast metals and alloys, high levels of control of system parameters are generally desirable to obtain high quality surface shape and condition in the resulting casting, especially in casting heavy metals and alloys as for example copper and copper alloys. In U.S. Pat. No. 4,014,379 a control system is described for controlling the current flowing through the inductor responsive to deviations in the dimensions of the liquid zone (molten metal head) of the ingot from a prescribed value. In U.S. Pat. No. '379 the inductor voltage is controlled to regulate the inductor current in response to measured variations in the level of the surface of the liquid zone of the ingot. Control of the inductor voltage is achieved by an amplified error signal applied to the field winding of a frequency changer.

One drawback of the control system of U.S. Pat. No. '379 is that only changes in the molten metal head due to fluctuation of the level of the surface of the liquid zone are taken into account. It appears that U.S. Pat. No. '379 has assumed that the location of the solidification front between the molten metal and the solidifying ingot shell is fixed with respect to the inductor. This is not believed to be the case in practice. Factors which tend to cause fluctuations in the vertical location of the solidification front include variations in casting speed, metal super heat, cooling water flow rate, cooling water application position, cooling water temperature and quality (impurity content) and inductor current amplitude and frequency.

Another control system for electromagnetically forming ingots of fixed transverse dimension is disclosed in U.S. Pat. No. 4,161,206, wherein variations in the gap between the molten metal and the inductor is minimized by sensing and using the gap or an electrical parameter related thereto to control the current to the inductor.

Both of the control systems of U.S. Pat. Nos. '379 and '206, and particularly that of U.S. Pat. No. '379, could be improved if accurate knowledge of the liquid metal head was available. U.S. Pat. No. '379 uses liquid metal level to estimate liquid head height, and U.S. Pat. No. '206 uses a technique which is less sensitive to variations in the head height.

There are several prior art systems for measuring the location of molten metal head in a container during continuous casting. One such system is shown in U.S. Pat. No. 3,204,460 and comprises a plurality of thermocouples spaced vertically along the container walls. The thermocouples measure temperature change within the container and control an electric circuit in response to such measurement. The invention in the '460 patent is based on the fact that a sharp change in the temperature measured within the container occurs as one travels from a pool of molten metal to a point above the pool and vice versa. The problem in adapting this approach to an EM casting system is twofold: first, there is no molten metal contacting mold wall or container in EM casting in which one can place the thermocouples, and second, the thermocouples would have to by necessity be placed between the EM inductor and the load, thereby interfering with and adversely affecting the currents induced by the inductor and complicating the casting zone.

Yet another approach to determining molten metal level in a mold during continuous casting is disclosed in U.S. Pat. No. 3,667,296. Electrical resistance wire probes are placed into the molten metal being cast. As the molten metal rises or falls, the resistance change in a circuit associated with the probes is ascertained and used as a level indication. The problems with using such a system in an EM casting station are twofold. First, reliability problems exist as a result of having a primary measurement device in contact with the melt. Second, use of probes during electromagnetic casting causes perturbations in the liquid metal meniscus which can result in casting defects.

Use of photo-electric devices, radiation responsive electrical devices, optoelectronic sensors and electro-optical scanning systems in locating the surface of molten metals in a container during continuous casting is disclosed in U.S. Pat. Nos. 4,015,128, 3,842,894, 3,838,727 4,132,259, and 4,160,168. All but one of the systems disclosed in these patents position the sensor devices such that the optical axis of the devices is at an angle with respect to the axis of the molten metal container. The devices are utilized in such a fashion that their axes intersect the surface of the molten metal and the walls of the container during a continuous casting run. The axis of the photo-electric device in U.S. Pat. No. 4,132,259 intersects the wall of a molten metal feed nozzle. These systems, in measuring in the visible light spectrum, presuppose a clear and uniform distinction between the container/feed nozzle and the molten metal surface color, and are primarily useful as a color determination of the melt due to characteristic wavelength emitted.

In contrast, an EM casting system has no mold or container walls to compare with. Moreover, EM systems typically utilize shields and coolant manifolds at the molten metal input ends of the primary casting zone. Utilization of such prior art electro-optical devices in the manner suggested by the aforementioned prior art would at the very least be complicated, if not impossible. Finally, in operating at the visable light spectrum, these devices are subject to inaccuracies based upon the existence of a dirty environment in or near a casting station.

A method of head top surface measurement which has been used during EM casting runs is depicted in U.S. Pat. No. 4,014,379, Canadian Pat. No. 913,323, and U.S.S.R. Pat. No. 338,036. Disclosed therein is the use of a float device which locates the upper surface of the molten metal being EM cast. Again, reliability problems associated with having the primary measuring device in contact with or subject to damage by the melt exist. This reliability problem also exists with respect to a feeler device disclosed in U.S. Pat. No. 3,646,988, the device being utilized to feel or locate the interface between the liquidus and solidus parts of an ingot being electromagnetically cast. In addition to reliability problems, these prior art patents require that additional equipment be added to the EM containment zone which complicates the EM casting apparatus and places the sensing elements in a very vulnerable position. Moreover, as noted hereinabove, use of such devices during electromagnetic casting may cause surface perturbations in the liquid metal meniscus which can result in casting defects.

Another system for locating the head top surface in an EM casting or containment zone and a continuous casting mold is disclosed in U.S.S.R. Pat. Nos. 338,297, 273,226, and bulletin report section "... Develops New Molten Metal Measuring System for Continuous-Casters ..." in the Journal of Metals, July 1979, pp. 14 and 15. All of these disclosures utilize at least one sensing coil placed in the vicinity of the molten metal surface in a continuous casting system. The impedance value of the coil, which varies as the molten metal moves up or down, is used as an indication of the location of the top surface of the melt. As with the feeler and float devices discussed hereinabove, this approach necessitates that additional equipment must be added to the EM containment zone thereby complicating the EM casting apparatus and placing the sensing elements in a vulnerable position.

Canadian Pat. No. 833,454 discloses the use of a system of intensified ultrasonic wave reflection at the solidification front of a continuously cast ingot in order to locate the front. The system involves the use of electromagnetic agitating coils in the area of the solidification front. Such a system is not readily adaptable to an EM casting system which, of course, itself is driven by an electromagnetic inductor.

U.S. Pat. No. 3,237,251 discloses the use of measuring systems utilizing electrical conductivity variation, high energy radiation, high frequency waves, and the like to measure the location of the depth of liquid center (core tip) in a continuously cast ingot so as to be able to control speed of withdrawal and prevent strand cutting and breakouts which put the casting machine out of operation. The measuring systems disclosed in U.S. Pat. No. '251 are all located at a point along the cast strand outside the mold or casting zone at the downstream end thereof and are not adapted for ready insertion and utilization in an EM casting zone wherein the melt is suspended within an inductor.

A system utilizing a plurality of fiber optic filaments secured within elements of an electromagnetic casting system, e.g. within the shield and/or manifold and/or inductor, to measure and determine the load surface height and location of the liquid-solid interface is disclosed in copending U.S. patent application Ser. No. 111,244 filed Jan. 11, 1980, by Ungarean et al. for "Infrared Imaging for Electromagnetic Casting". The system uses infrared radiation emitted from the surface of the forming ingot as a measure of the desired parameters. This system has the benefits of not requiring the insertion of probes into the primary casting zone, and provides other information, such as liquidus temperature and maximum temperature. One problem with this approach, however, is that the system of filaments is inserted within elements of the casting system, requiring modification of the affected elements.

Finally, a process of measuring head top surface location during electromagnetic casting of metals and alloys utilizing screen inductance is disclosed in copending U.S. patent application Ser. No. 137,596, filed Apr. 7, 1980, by Kindlmann et al. for "Head Top Surface Measurement Utilizing Screen Parameters in Electro-magnetic Casting" (now abandoned). By monitoring various parameters such as the current in the non-magnetic shield, as well as voltage across the shield, and the current or current and voltage in the inductor, determination of the proximity of the head top surface to the shield is carried out. While this system has the benefit of being able to determine the location of the load upper surface without introduction of probes or modification of the electromagnetic casting system elements, it is limited to the extent that the location of the liquid-solid interface and the value of other electromagnetic casting parameters which may be of interest are not determined.

The present invention overcomes the deficiencies described above and provides an accurate means for measuring head and the location of the peripheral liquid-solid interface of the forming ingot in an electromagnetic casting station without necessitating the introduction of any sensing element into the EM casting zone enclosed by the inductor and shield without modification of the inductor or shield, simultaneously, reliably, and without creation of any safety hazards (such as would be introduced for example by devices utilizing high energy radiation). In addition, the measuring system of the present invention operates efficiently in a less than perfectly clean environment such as would be found in an EM primary casting zone.

All patents and publications described herein are intended to be incorporated by reference herein.

SUMMARY OF THE INVENTION

The present invention relates to a process and apparatus for determination and display of molten metal head and liquid-solid interface position during an electromagnetic casting run by utilizing the in-phase component of the voltage across the inductor as an indicator of head and interface position.

In accordance with a preferred embodiment, the equivalent series resistance (ESR) of the casting system, including the load, is measured and monitored during the casting run. The value of this parameter is then compared with a table or chart relating the ESR of the system and the values of or changes in the values of head and liquid-solid interface position for a given metal or alloy being cast.

Signal generation and analysis in accordance with this invention can be carried out using either analog or digital circuitry or combinations thereof.

Accordingly, it is an object of the present invention to provide an improved process and apparatus for continuously monitoring the molten metal head or changes in head and the location or changes in location of the liquid-solid interface of an electromagnetically cast ingot during an EM casting run without inserting or placing probes or other devices into the primary casting zone and without requiring alteration in the construction of the inductor, non-magnetic shield, or other primary elements of the electromagnetic casting apparatus.

It is a still further object of this invention to utilize at least one electrical parameter of the electromagnetic casting system to provide a signal indicative of the head and liquid-solid interface position and/or changes therein during an electromagnetic casting run.

These and other objects will become more apparent from the following description and drawings.

DETAILED DESCRIPTION OF THE PREFERRED EMBODIMENTS

Figure 1:
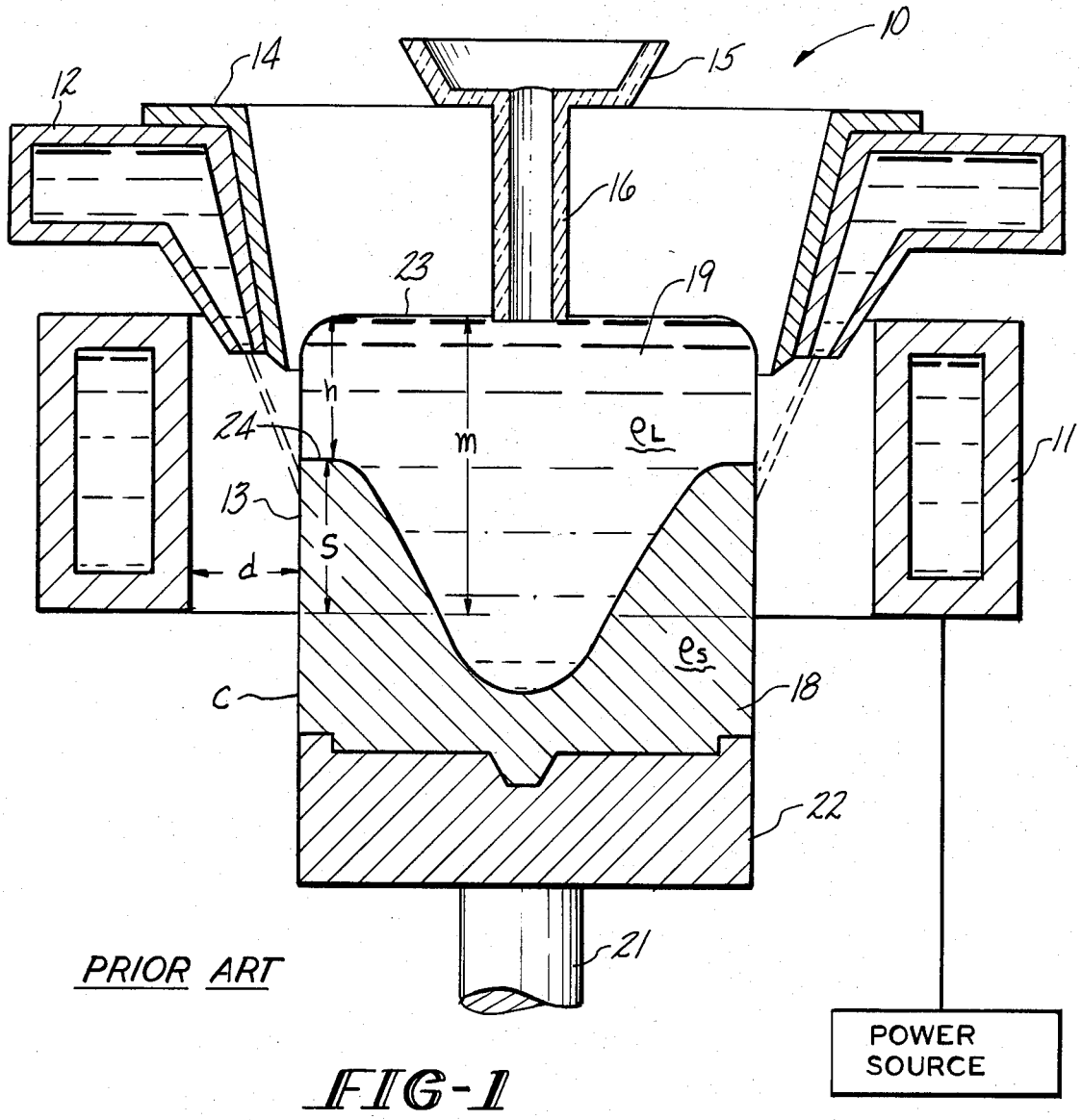
FIG. 1 is a schematic representation of a prior art electromagnetic casting apparatus.

Referring now to FIG. 1, there is shown by way of example a prior art electromagnetic casting apparatus such as that shown in U.S. Pat. No. 4,161,206.

The electromagnetic casting mold 10 is comprised of an inductor 11 which is water cooled; a cooling manifold 12 for applying cooling water to the peripheral surface 13 of the metal being cast C; and a non-magnetic shield 14. Molten metal is continuously introduced into the mold 10 during a casting run, in the normal manner using a trough 15 and down spout 16 and conventional molten metal head control. The inductor 11 is excited by an alternating current from a power source 17.

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap d exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic shield 14 is to fine tune and balance the magnetic pressure with the hydrostatic pressure of the molten metal head 19. The non-magnetic screen 14 may comprise a separate element as shown or may, if desired be incorporated as a unitary part of the manifold for applying the coolant.

Initially, a conventional ram 21 and bottom block 22 are held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. In the embodiment which is shown in FIG. 1, the water is applied to the ingot surface 13 within the confines of the inductor 11. The water may be applied to the ingot surface 13 above, within or below the inductor 11 as desired.

The present invention describes a technique for measurement of liquid head utilizing certain electrical parameters of containment inductor 11. The in-phase current amplitude Io in containment inductor 11 is monitored, and signals representative of the magnitude or amplitude thereof are then utilized to extract head height and liquid-solid interface location information.

The in-phase current Io is a function of the resistive part of the total inductor load impedance which is made up of the resistance of inductor 11 itself, that of the shield 14 and that of the contained solid-liquid metal load. To a first order approximation, the resistance of the inductor 11 and shield 14 are constant at constant frequency. The resistance of the liquid-solid load at constant frequency is a function of the metal or alloy being cast and the proportions of liquid and solid involved because the resistivities of the two states ($\rho_S$, solid and $\rho_L$, liquid) differ significantly. In addition, the load resistance is a function of the air gap, d (load periphery). Thus, if all system parameters are known or monitored except the load liquid-solid interface position, then the resistance of the load seen at the inductor terminals changes as the load liquid-solid interface moves up and down within the casting zone.

Accordingly, if one were to know the frequency, the resistances of the inductor 11 and the shield 14, the air gap d and load height m and the total resistive load, it would then be possible to extract or solve for the proportion of liquid and solid and hence determine the actual depth of liquid h (head). Once the liquid level is known, computation of the location of the liquid-solid interface (s) within the inductor can be determined. The parameters and factors of interest thus become:

f=frequency;

$R_L$=resistance of the inductor 11;

$R_S$=resistance of the shield 14;

d=inductor-ingot air gap;

m=load height;

ESR=total resistance load or equivalent series resistance of the casting system as seen at the terminals of inductor 11;

h=head; and s=location of liquid-solid interface.

For a typical application, the resistances of the shield and inductor, as well as temperature of operation, can be taken as constant in that their position is fixed during the casting run.

The frequency f is either known, being a controlled element of the electromagnetic casting system, i.e. a system driven at a known or set frequency, or it can be measured by use of a frequency counter or frequency meter. The resistance of the shield ($R_S$) and inductor ($R_L$) is as stated hereinabove assumed approximately constant and can be determined by measurements using an appropriate inductance/resistance meter. The inductor-ingot air gap d can be conveniently extracted from a measurement of out of phase inductor current, $I_{90}$ as set forth in U.S. Pat. No. 4,161,206. This parameter is either known, being maintained constant (preferred) or can be constantly monitored as disclosed in U.S. Pat. No. '206.

The liquid metal level relative to the inductor m can be ascertained by any of several techniques including probes, floats or coils as described in the Prior Art Statement hereinabove.

Preferably, however, this parameter can be derived from a measurement of the out of phase current in the shield as described in aforementioned copending U.S. application Ser. No. 137,596 (now abandoned).

Determination of the values of h, head height and s liquid solid interface location are then made possible in the following manner.

The equivalent series resistance (ESR) represents the total resistance load seen when looking into the two terminals of inductor 11 and includes the resistances of the shield 14, inductor 11, and the load. The ESR is a function of several parameters including the values of d, h, and m. As disclosed hereinabove, except for the value of h, the values of d and m are either known or can be readily determined. Thus, if one were to monitor or determine the value of the ESR, then it would be possible to calibrate or chart the value of the head (h).

It is, of course, not actually necessary to measure the load resistance per se, rather knowing $R_S$ and $R_L$ one can simply monitor the in-phase component of the current in inductor 11 and the voltage across inductor 11 to determine the ESR of the casting system and thereafter compare this parameter to known values of the parameter for the same alloy and for known liquid-solid interface levels and other known geometric parameters (d, m, etc.) to enable detetermination of h by interpolation. Values of the ESR for different geometric arrangements and liquid-solid load resistivities can be determined by suitable modeling and confirmed by careful measurement during actual electro-magnetic casting experiments. Establishment of calibration charts and tables utilizing this type of modeling approach is disclosed in the aforementioned U.S. application Ser. No. 137,596 (now abandoned).

Figure 2:
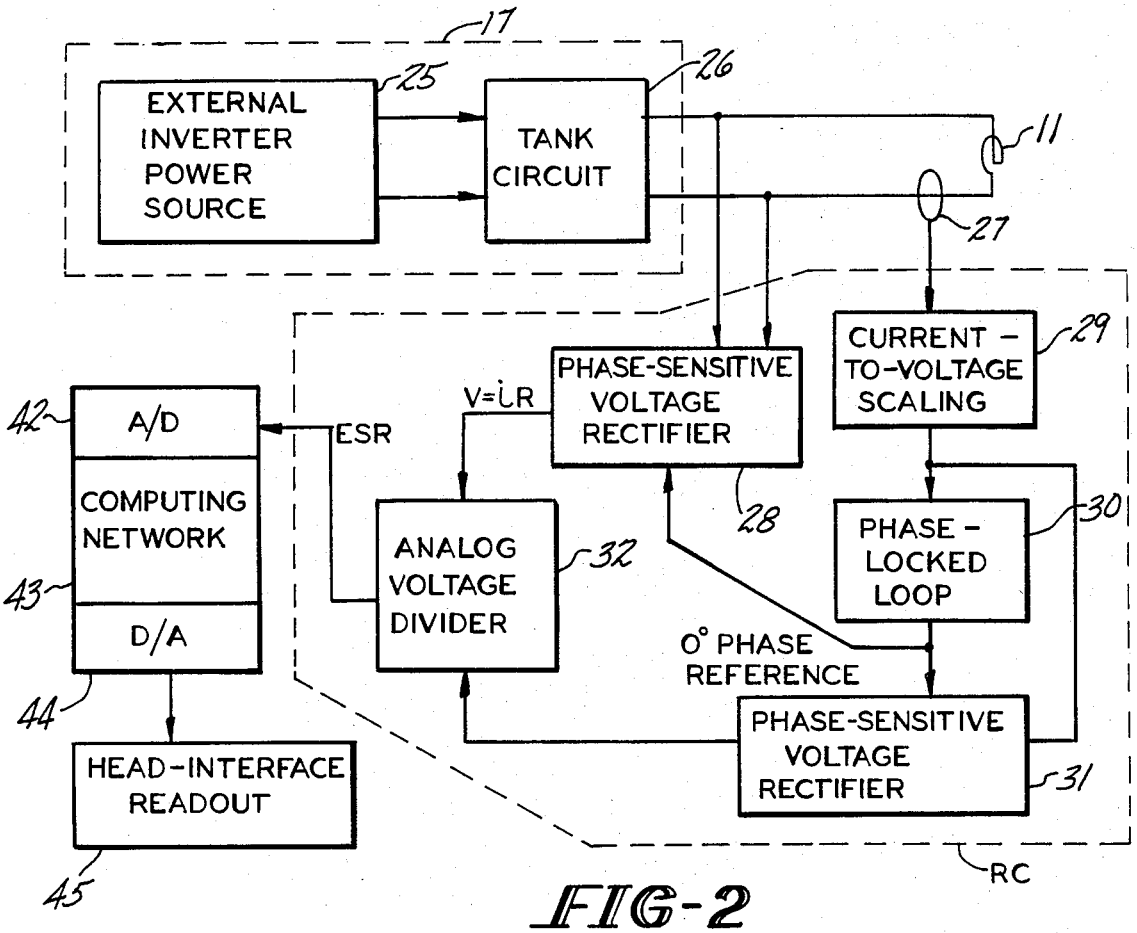
FIG. 2 is a block diagram of a monitoring system in accordance with this invention showing monitoring of the equivalent series resistance of an electromagnetic casting system during a casting run as an indication of head and liquid-solid interface location.

FIG. 2 is a block diagram showing a system for monitoring an electromagnetic casting system in order to determine head and/or liquid-solid interface location during a casting run. Referring to FIG. 2, inductor 11 is shown connected to an electrical power supply 17 which provides the necessary current to the system at a desired frequency and voltage. As disclosed in aforementioned U.S. Pat. No. 4,161,206, power supply circuit may be considered as two subcircuits 25 and 26. The external circuit 25 consists essentially of a solid state generator providing an electrical potential across the load or tank circuit 26 which includes the inductor 11. Tank circuit 26 except for the inductor 11 is sometimes referred to as a heat station and includes elements such as capacitors and transformers. Both external circuit 25 and tank circuit 26 may be of a conventional design.

FIG. 2 includes a subcircuit RC which may be utilized in monitoring the equivalent series resistance (ESR) of a typical electromagnetic casting system. The current in inductor 11 may be sensed by a conventional current sense pickup device 27 such as a current transformer. A current-to-voltage scaling resistor network 29 generates a corresponding voltage. This voltage is fed to a phase-locked loop circuit 30 which "locks" onto the fundamental of the current waveform and generates a sinusoidal phase reference output having a phase angle of 0° with respect to the current fundamental. Using this reference, phase-sensitive voltage rectifier 31 derives the fundamental frequency current amplitude. The voltage signal from phase sensitive voltage rectifier 31, properly scaled, is then fed to analog voltage divider 32. Phase-sensitive voltage rectifier 28 generates a signal corresponding to the in-phase (0°) voltage across inductor 11, which signal, properly scaled, is also fed to analog voltage divider 32. Analog voltage divider 32 divides the signals from phase-sensitive rectifiers 28 and 31, respectively, to obtain an output signal which is representative of the equivalent series resistance of the casting system which includes the load, inductor 11 and shield 14.

Having thus monitored the ESR of the system by monitoring the in-phase component of the current in inductor 11 and the voltage across inductor 11, it now becomes possible to utilize this measure of resistive voltage drop as an indicator of the head h and the liquid-solid interface position s.

Figure 3:
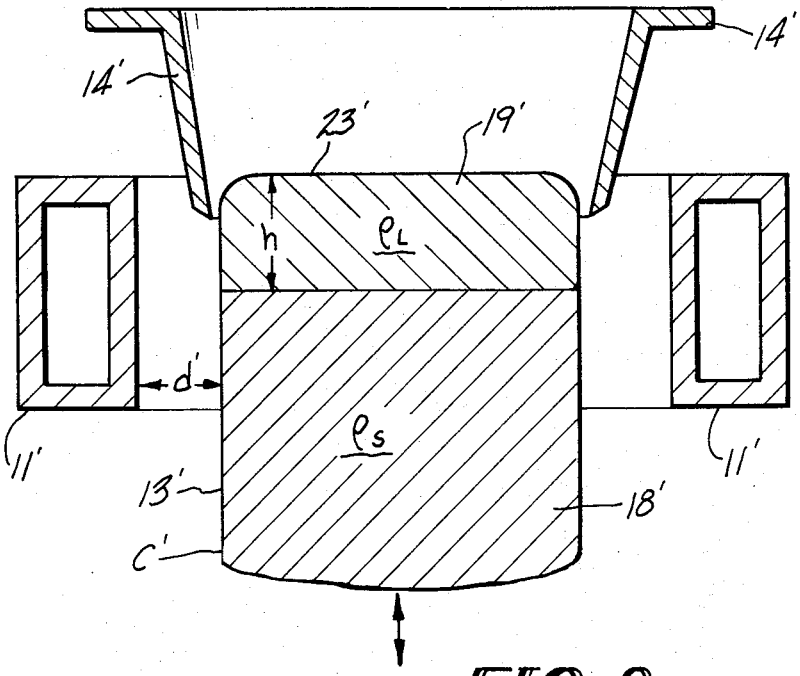
FIG. 3 is a schematic representation in section of an electromagnetic casting system model, including a load model portion, for reproducing or mimicking system parameters produced during an electromagnetic casting run.

As stated hereinabove, determination of liquid head h and liquid-solid interface position s is carried out by interpolation. Values of the ESR for different geometric arrangements, values of h, and liquid-solid load resistivities can be determined by suitable modeling and empirical measurement procedures and thereafter confirmed by careful measurement during actual electromagnetic casting experiments. Thus, scaling is performed by empirical measurement based solely on experiment utilizing a model system and observation of a particular geometrical and alloy electromagnetic casting system. Such a model electromagnetic system suitable for empirical measurements is depicted in FIG. 3.

The contribution to the ESR from the load includes resistance contributions from the liquid and solid portions of the forming ingot. The resistivity of the molten metal ($\rho_L$) is substantially different than the resistivity of the solid metal ($\rho_S$). Thus, if the system parameters are approximately constant except for the location of the liquid-solid interface then the resistance of the load changes as the location of the liquid-solid interface changes, that is, as the interface goes up the equivalent series resistance at the terminals of inductor 11' decreases. Knowing or being able to measure d and m, a model as depicted in FIG. 3 can be set up so as to permit empirical establishment of a chart or table relating the ESR and the values of h and s for specific alloys and geometric arrangements. To establish such a chart or table, a load C' model is set up to move vertically within the casting zone established by an inductor 11' and a shield 14' of a size and positioned in the same way as during the intended casting run. It is, of course, possible to utilize the actual casting station and/or the inductor 11 and shield 14 which would be utilized during the casting run.

In constructing a load model for empirical measurements, it is not essential that the liquid-solid front (24) or interface front be approximated through the entire load thickness, that is, the interface need not duplicate the entire interface 24 of the load during the casting run. The primary area of electromagnetic interaction is two penetration (skin) depths ($2\delta$) around the ingot or load model periphery. The penetration of depth $\delta$ is, of course, a function of the resistivity of the alloy being cast and the frequency at which the system is running. A constant diameter metal head 19' such as that depicted in FIG. 3 may be utilized to carry out empirical measurements for the parameter values, geometries, and alloy to be cast. Such an interface would tend to give a little lower reading in the in-phase part of the current in inductor 11, that is, the reading would tend to indicate that the liquid-solid interface peripheral front is a little higher than it actually is during the casting run. Testing can determine whether there is a sufficient discrepancy, and if so, whether it is tolerable or not. In any case adjustment can be built into the chart or table, or more exact load model construction can be carried out. Finally, if the system is utilized as a determiner of variation or deviation from a desired value rather than as an exact determination of a value or position, then discrepancies might be more readily tolerable.

The load model C' has a solid upper portion 19' constructed of a material having a resistivity $\rho_L$ which closely approximates the resistivity of the molten alloy which is to be cast and a solid lower portion 18' constructed of a material having a resistivity $\rho_S$ which closely approximates the resistivity of the solid portion of the alloy being cast. The procedure now would be to set up the electro-magnetic casting model and to move the load model up and down within the model casting zone to establish the correlation between changes in ESR as a function of liquid-solid interface location or position s. To determine changes in ESR as a function of head height h, the solid upper portion of the load model can be changed, that is, readings in ESR variation can be taken for several different values of h.

It should, of course, be understood that various geometries can be charted. For example, different size inductors and shields, different shield locations, different values of d, etc. can be utilized to empirically measure and and scale or chart the electromagnetic casting system to be run.

Referring again to FIG. 2, it can now be seen that as a result of empirical model measurements the signal corresponding to the ESR emanating from analog voltage divider 32 may now readily be utilized as an indicator of head h and the position of the liquid-solid interface s. This output signal is fed to analog to digital converter 42 which converts it into an appropriate digital form. The output of the analog to digital converter 42 is fed to a computer 43 such as a mini-computer or microprocessor as, for example, a PDP-8 with Dec Pack manufactured by Digital Equipment, Inc. The computer 43 is programmed to analyze the signal from analog voltage divider 38 in conjunction with preprogrammed geometrical and electrical parameter data to compute via a programmed chart established through empirical testing data the value of or variation in head h and liquid-solid interface position s.

Computer 43 then generates a signal corresponding to the value of or variations in head h and interface position s to analog converter 44 which converts the signal into an analog form which can be read on one or more readout devices 45.

Monitoring of the ESR of the casting system can be carried out by digital means, analog, or a combination of both, and the circuit of FIG. 2 merely represents one preferred form of circuitry for carrying out the monitoring and determining steps of the present invention. Reference is made to the aforementioned U.S. Pat. No. 4,161,206 which shows digital and analog circuitry performing the same or similar functions with respect to an electromagnetic casting system. However, in accordance with the present invention, the use of a microprocessor or computer is thought to be highly desirable because such a device can readily interplate between varying points in a chart or table and would, therefore, be quite efficient in continuously providing readings of the value of or deviations from a prescribed value of h and s. In addition, the more parameters which must be manipulated, measured and monitored, and the more relationships which are determined by empirical measurements for various alloys and geometries, the more attractive the use of a computer, microprocessor or digital means becomes. The data acquisition properties of a computer can actually create a table relating head h and liquid-solid interface position s to the equivalent series resistance (ESR) and the various parameters of the system being monitored and/or controlled. When utilizing a computer, a space grid of values so established can be used in an interpolative sense whereas when utilizing analog circuits, one must use actual values.

Finally, it should, of course, be readily apparent that the high speed with which head h and liquid-solid interface position s readout can be displayed and generated via a computer during an electromagnetic casting run in response to ESR signals is quite desirable, and a high degree of sensitivity and flexibility is typically associated with the use of digital circuitry and computer programming.

The monitoring and determination system of the instant invention finds utility in two types of measurements and readouts. It may be utilized to measure or approximate head height and/or liquid-solid interface position relative to some datum point, as for example, the bottom of inductor 11, or it may be utilized to monitor and determine a departure or variation in head height and/or interface position relative to a desired position or value. It is clear that in the latter use, linearity and exact proportionalities are less critical, that is, such a use permits or can tolerate greater slope differences. It is contemplated that such a monitoring system as an alternative to use as an absolute calibration device or interface meter might best be utilized as a reproducibility or error sensing mechanism. Thus, deviations in maintaining the head (h) at a desired value and the liquid-solid interface at a desired level (typically at the center of inductor 11) can be readily ascertained.

The process of the present invention is operable whether frequency (f) varies or not. By determining the equivalent series resistance (ESR) of the circuit as seen across the terminals of inductor 11, it becomes possible to calibrate how the ESR varies for a given system with frequency (f). This determination can be established by empirical model testing as discussed hereinabove. By measuring the frequency at any point in time during the casting run, it can then be utilized as one of the parameters in determining the value of the head (h) and the interface location (s).

Finally, it should be understood that the processing mode of the ESR monitored in the electromagnetic circuit may be analog, digital, or a hybrid of both. See for example the alternative analog or digital processing systems of U.S. Pat. No. 4,161,206.

The programming of computer 43 and its memory can be carried out in a conventional manner and, therefore, such programming does not form a part of the invention herein.

The prior art citations set forth in this application are intended to be incorporated by reference herein.

It is apparent that there has been provided with this invention a novel process and means for determination of molten metal head and liquid-solid interface position during an electromagnetic casting run which fully satisfy the objects, means, and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. In an electromagnetic casting system for casting material comprising:

means for electromagnetically containing molten material and for forming said molten material during a casting run into a casting of desired shape, said casting including during said casting run a liquid-solid interface defining molten material head and solid material portions of said casting, said electromagnetic containing and forming means including an inductor for applying a magnetic field to said molten material, said magnetic field defining a containment zone for said molten material and a gap between said molten material and said inductor, means for applying an alternating current to said inductor to generate said magnetic field, means for controlling the current applied to said inductor whereby said gap remains substantially constant, a non-magnetic shield for attenuating and shaping said magnetic field, the improvement comprising:

means for monitoring the location of said liquid-solid interface, said liquid-solid interface monitoring means including first means for determining at least a first electrical parameter of said electromagnetic casting system which varies with variations in the location of the liquid-solid interface, wherein said first electrical parameter substantially corresponds to the equivalent series resistance of the electromagnetic casting system; and means responsive to said first determining means for generating a readout signal representative of the location of said liquid-solid interface.

2. An electromagnetic casting system as in claim 1 wherein said first means for determining includes means for sensing both the current in said inductor and the voltage across said inductor and generating first and second signals corresponding to the in-phase current in said inductor and the in-phase voltage across said inductor, respectively, said first determining means further includes means responsive to the first and second signals for generating an output signal substantially corresponding to the equivalent series resistance of said electromagnetic casting system.

3. An electromagnetic casting system as in claim 2 wherein said first means for determining said at least one electrical parameter further includes means for comparing said output signal to a preprogrammed table establishing the relationship between different values of said output signal and different locations of the liquid-solid interface.

4. An electromagnetic casting system as in claim 2 wherein said means for determining said first electrical parameter further includes:

means for generating a 0° phase reference output signal;

first phase-sensitive voltage rectifier means receiving said 0° phase reference output signal and a voltage signal corresponding to the current in the inductor for generating a voltage signal corresponding to the in-phase (0°) current in said inductor; and second phase-sensitive voltage rectifier means receiving said 0° phase reference output signal and said voltage across said inductor for generating a voltage signal corresponding to the in-phase (0°) voltage across said inductor.

5. An electromagnetic casting system as in claim 4 wherein said means for generating said 0° phase reference output signal comprises a phase-locked loop circuit.

6. An electromagnetic casting system as in claim 5 further including means for converting the sensed current in said inductor to a properly scaled voltage to provide a current signal in voltage form for application to said phase-locked loop circuit and said first phase-sensitive voltage rectifier means.

7. An electromagnetic casting system as in claim 5 further including voltage divider means for dividing said voltage signal corresponding to said in-phase current in said inductor by said voltage signal corresponding to said in-phase voltage across said inductor to obtain said output signal substantially corresponding to the equivalent series resistance of said electromagnetic casting system.

8. In a process for continuously and semi-continuously electromagnetically containing and forming molten material during a casting run into a casting of desired shape, said casting having during said casting run a liquid-solid interface defining a head of molten material and a solid material portion of said casting, said electromagnetic containing and forming including the steps of: providing an inductor, applying a current in and a voltage across said inductor to generate and apply a magnetic field to said molten material; and applying said magnetic field to said molten material to define a containment zone of said molten material and a gap between said molten material and said inductor; controlling the current to the inductor so that the gap remains substantially constant; providing a non-magnetic shield for attenuating and shaping said magnetic field; the improvement comprising the steps of:

monitoring the location of the liquid-solid interface by determining at least a first electrical parameter of the electromagnetic casting system during said run, said at least first electrical parameter varying with variations in the location of the liquid-solid interface, wherein said first electrical parameter substantially corresponds to the equivalent series resistance of the electromagnetic casting system; and responsive to said step of determining, generating a readout signal representative of the magnitude of the liquid-solid interface.

9. A process as in claim 8 wherein said step of determining said at least first electrical parameter comprises sensing the current in said inductor and the voltage across said inductor and generating first and second signals corresponding to the in-phase current in said inductor and the in-phase voltage across said inductor, respectively, and said step of determining said first electrical parameter further comprises generating an output signal substantially corresponding to the equivalent series resistance of said electromagnetic casting system in response to said first and second signals.

10. A process as in claim 9 wherein said determining step further includes the step of:

comparing said output signal to a preprogrammed table establishing at least the relationship between different values of said output signal and different locations of said liquid-solid interface for the particular casting system being monitored.

* * * * *